US005138331A

United States Patent [19]

Josypenko

[11] Patent Number: 5,138,331

[45] Date of Patent: Aug. 11, 1992

[54] BROADBAND QUADRIFILAR PHASED ARRAY HELIX

[75] Inventor: Michael J. Josypenko, Norwich, Conn.

[73] Assignee: The United States of America as represented by the Secretary of the Navy, Washington, D.C.

[21] Appl. No.: 599,559

[22] Filed: Oct. 17, 1990

[51] Int. Cl.[5] ..... H01Q 11/08; H01Q 1/36; H01Q 5/000

[52] U.S. Cl. ..... 343/895; 343/853

[58] Field of Search ..... 343/895, 853, 700

[56] References Cited

U.S. PATENT DOCUMENTS

| | | | |
|---|---|---|---|
| 3,503,075 | 3/1970 | Gerst | 343/895 |
| 3,906,509 | 9/1975 | DuHamel | 343/895 |
| 4,008,479 | 2/1977 | Smith | 343/895 |
| 4,011,567 | 3/1977 | Ben-Dov | 343/895 |
| 4,101,901 | 7/1978 | Kommrusch | 343/853 |

OTHER PUBLICATIONS

C. C. Kilgus, Resonant Quadrifilar Helix Design, Microwave Journal, Dec. 1970, pp. 49–54.

*Primary Examiner*—Michael C. Wimer
*Assistant Examiner*—Peter Toby Brown
*Attorney, Agent, or Firm*—Michael J. McGowan; Prithvi C. Lall; Michael F. Oglo

[57] ABSTRACT

A broadband quadrifilar phased array helix antenna is comprised of a pair of bifilar arrays spaced 90° on a coaxial fiberglass tube. A 90° feed phase exists between the bifilar arrays. Each bifilar array has three elements with the longest element having approximately twice the length of the shortest element and all three elements being of a length to give good broadband coverage over a specified range with specified shaped patterns being required. A 180° feed phase exists between adjacent elements. A number of trimming adjustments to the design of the antenna are presented for obtaining improved performance.

2 Claims, 2 Drawing Sheets

BROADBAND QUADRIFILAR PHASED ARRAY HELIX

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to helical antennas. More particularly the invention pertains to a broadband, phased array, quadrifilar helical antenna that must form particular patterns and coverage at particular frequency ranges on the horizon, near the horizon and overhead.

(2) Description of the Prior Art

In general, previous one short element quadrifilar helix arrays could not provide simultaneous broadband (225 MHz to 400 MHz) impedance, and broadband and broadbeamed cardioid shaped pattern performance. A quadrifilar helix antenna presently used by the Navy is mounted on a mast for satellite coverage. It has a good broadband match since its elements are longer than one wavelength. Broadband matched overhead patterns are obtained for this antenna by making the antenna a $1\frac{5}{8}$ turn quadrifilar helix. However, the antenna is long and is designed to operate up to 320 MHz. Below one wavelength, a shorter $\frac{3}{4}$ turn quadrifilar helix also has broad beamed patterns. However, near one wavelength, the patterns start to split overhead. To provide acceptable overhead patterns from 225 MHz to 400 MHz, this antenna would have to operate below one wavelength with an expected broadband match, after impedance matching, of about 7:1 VSWR. VSWR is Voltage Standing Wave Ratio which describes the amount of power transmitted (or received) by the antenna and it is 1:1 for an ideal case.

SUMMARY OF THE INVENTION

Accordingly, it is a general purpose and object of the present invention to provide an improved broadband antenna. It is a further object that the broadband antenna provides specific patterns overhead and, both near and at the horizon within specific frequency ranges.

These objects are accomplished with the present invention by providing a multiple element quadrifilar helix array comprised of two bifilar multiple element helix arrays. The two bifilar multiple element helix arrays are mounted 90° apart on a coaxial supporting tube and have a feed phase difference of 90°. Each bifilar multiple element array has three elements. The three elements have filars of different lengths with each adjacent filar within a bifilar array having a feed phase difference of 180°.

DESCRIPTION OF THE PREFERRED EMBODIMENT

A broadband antenna in terms of impedance and patterns was required for the frequency range of 225 MHz to 400 MHz. The bands to be covered in the 225 MHz to 400 MHz range with their required pattern type are as follows:

225 MHz–400 MHz LOS (Line of Sight Function)

A pattern of at least vertical polarization on the horizon was required. Gain overhead was not needed.

240 MHz–270 MHz SATCOM (Satellite Communication) Receive, 290 MHz–320 MHz SATCOM Transmit A circular polarized pattern with a cardioid shape overhead was needed. The pattern had to be broadbeamed enough to at least cover satellites near the horizon (ten degree limit).

240 MHz–270 MHz AFSAT (Air Force Satellite Communication) Receive, 360 MHz–400 MHz AFSAT Transmit.

A circular polarized pattern with a cardioid shape overhead was needed. The pattern had to be broadbeamed enough to at least cover satellites near the horizon (ten degree limit).

Figure 1A:
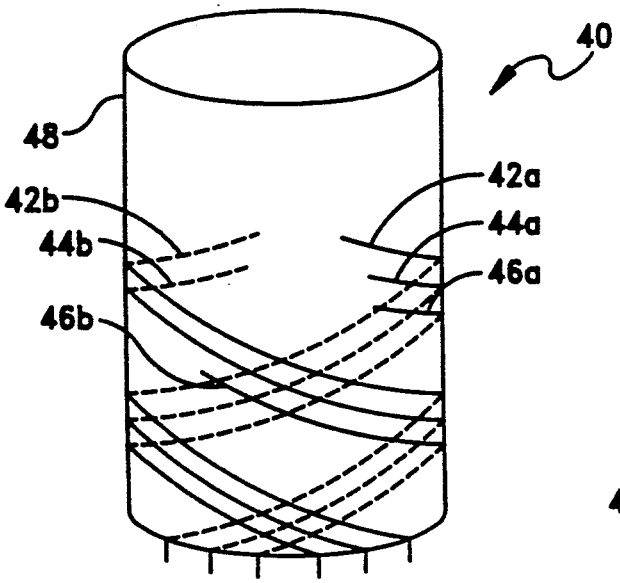
FIG. 1A is a pictorial representation of a bifilar phased array helix.
Figure 1B:
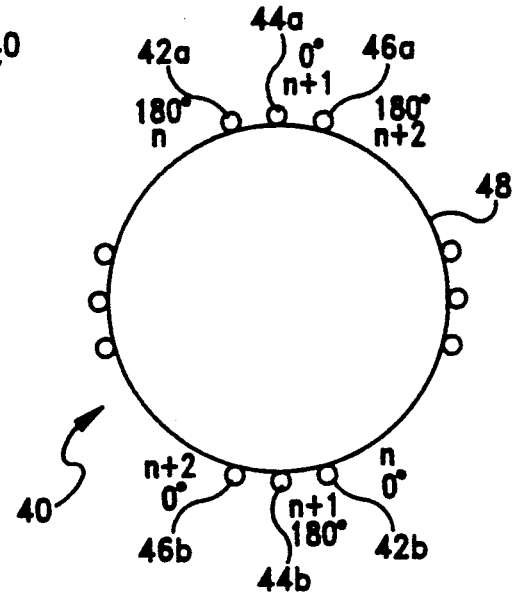
FIG. 1B is a representation of the bifilar phased array helix of FIG. 1A showing the location of filars at the end of a tube.
Figure 2:
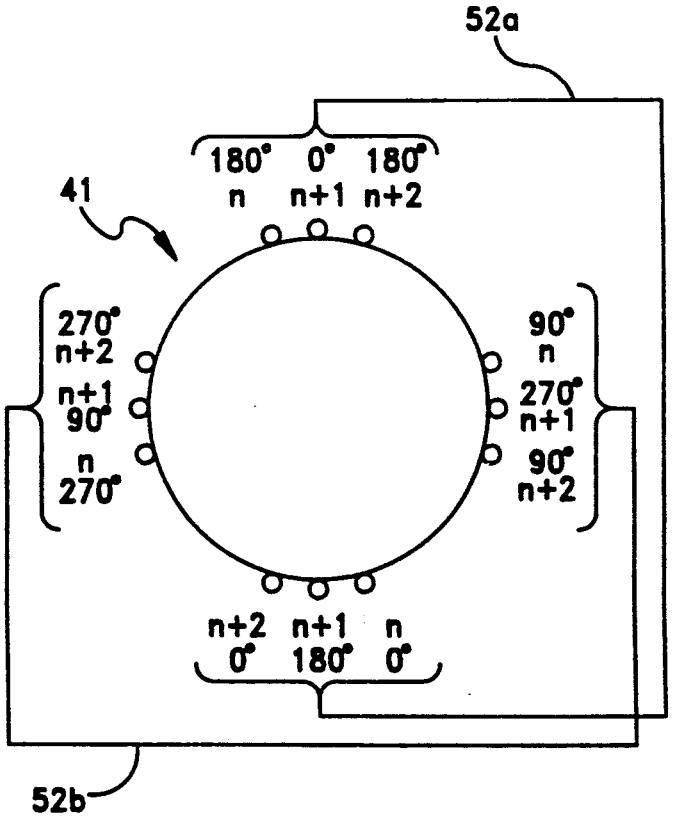
FIG. 2 is a view of a quadrifilar phased array helix showing the location of filars at the end of a tube.

Refer now to FIGS. 1A, 1B, and 2 for the evolution of the helix antenna from a bifilar phased array helix 40, of FIGS. 1A and 1B, to the resultant quadrifilar phased array helix 41 of FIG. 2.

A bifilar phased array helix antenna 40 is shown in FIG. 1A with the filars 42*a* and 42*b*; 44*a* and 44*b*; and 46*a* and 46*b* mounted on a tube 48. By definition, a filar is one wire, such as 42*a*, wrapped in a helical shape along the length of a coaxial supporting tube. The antenna 40 comprises an array of bifilar helix elements 42*a* and 42*b*; 44*a* and 44*b*; and 46*a* and 46*b*; mounted on a coaxial tube 48. Bifilar helix elements are two filars, such as 42*a* and 42*b* mounted 180° apart from each other on a coaxial supporting tube with a feed phase difference of 180° existing between the filars. A physical space of 10° to 20° separates adjacent filars of each side of the array. Normally, the elements are arranged by element length, with the longest element being labeled n, the next longest being labeled n+1, etc, as shown in FIG. 1B. A feed phase of approximately 180 degrees exist between adjacent elements.

A representation of a quadrifilar phased array helix 41 showing the location of bifilar arrays 52*a* and 52*b* on a tube 54 is shown in FIG. 2. This antenna 41 comprises the two bifilar arrays 52*a* and 52*b* mounted at a spacing of 90° on the coaxial supporting tube 54. A feed phase of 90° exists between adjacent bifilar arrays 52*a* and 52*b*.

Figure 3:
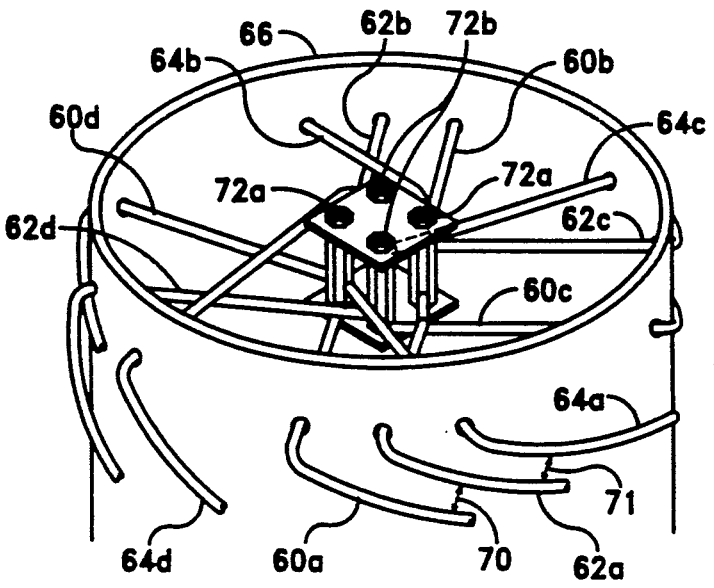
FIG. 3 is a pictorial representation of a specific quadrifilar phased array helix showing the arrangement of components within the feed end of the tube.
Figure 4:
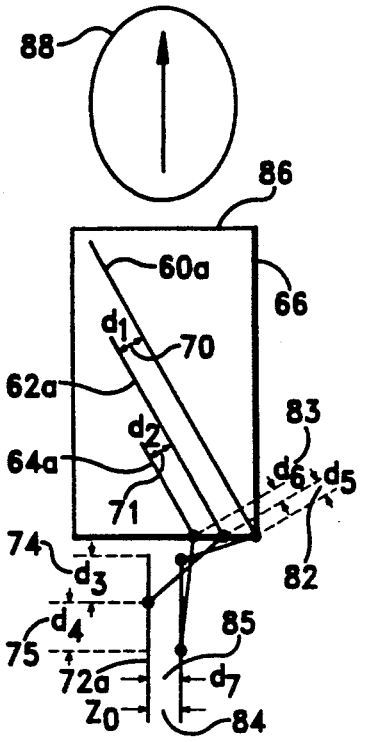
FIG. 4 shows a basic configuration of specific components of the quadrifilar phased array helix of FIG. 3.
Figure 5:
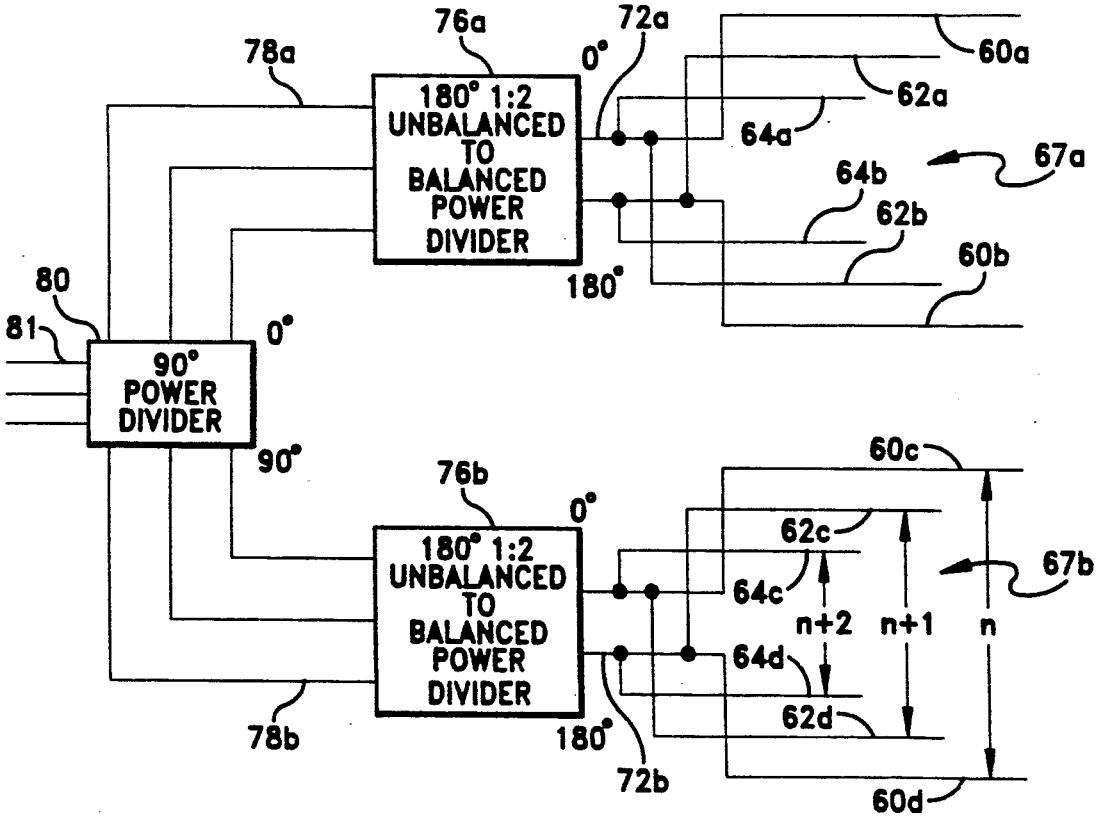
FIG. 5 is a block diagram of the quadrifilar phased array helix of FIG. 3 showing the element phasing.

Refer now to FIGS. 3 through 5 for a description of a specific quadrifilar phased array antenna that meets the requirements given at the beginning of this section.

Three pairs of $\frac{1}{8}$" diameter copper tubes 60*a* and 60*b*; 62*a* and 62*b*; and 64*a* and 64*b* are wound on a 5.5" diameter, 1/16" thick fiberglass tube 66 to form a three element bifilar helix array 67*a* with each copper tube being a filar. Radially opposite pairs of copper tubes such as 60*a* and 60*b* comprise one element of an array. A second identical three element bifilar helix array 67*b* comprised of copper tubes 60*c* and 60*d*; 62*c* and 62*d*; and 64*c* and 64*d* is also mounted on the tube 66. The two bifilar helix arrays are mounted 90° apart on the tube 66 to form a complete quadrifilar helix antenna array. The elements 60*a* and 60*b*; and 60*c* and 60*d* are of a length n, the longest size element. The elements 62*a* and 62*b*; and 62*c* and 62*d* are of a length n+1, the middle sized element. The elements 64*a* and 64*b*; and 64*c* and 64*d* are of a length n+2, the shortest size element.

Each filar of elements n 60*a* and 60*b*; and 60*c* and 60*d* are wound approximately one turn for an axial distance of 25". Elements n+2 64*a* and 64*b*; and 64*c* and 64*d* are approximately ½ as long as the elements n 60*a* and 60*b*; and 60*c* and 60*d*. The actual length of each filar of the elements is: n filar=33.43", n+1 filar=25.875", and n+2 filar=17.42". The distances $d_1$ (70) separating the filars of the elements n and n+1 from each other along the fiberglass tube 66 was set at approximately 0.9". The distances $d_2$ (71) separating the filars of the elements n+1 and n+2 from each other was set at approximately 0.7". The three elements for antenna arrays 67*a* and 67*b* are respectively connected to short balanced transmission lines 72*a* and 72*b*.

The distances $d_3$ (74) separating the element feed points on the transmission lines 72*a* and 72*b*, shown for transmission line 72*a* in FIG. 4, initially is set to the same separation $d_1$ (70) that separates the filars of the elements n and n+1 on the fiberglass tube 66, shown in FIG. 3. The distance $d_4$ (75) separating the element feed points on the transmission lines 72*a* and 72*b*, shown for transmission line 72*a* in FIG. 4, is initially set to the same separation $d_2$ (71) that separates the filars of the elements n+1 and n+2 on the fiberglass tube 66 shown in FIG. 3. The transmission lines 72*a* and 72*b* are each two inches long and have a 5° to 10° phase shift between adjacent connecting points of the elements.

Refer now particularly to FIG. 5. RF is applied to the quadrifilar phased array antenna at the 50 ohm input 81 of a 90° three dB power divider 80. The two output ports of power divider 80 are connected to two 50 ohm input ports of transformers 76*a* and 76*b* by 1.5 inch long 50 ohm coaxial lines 78*a* and 78*b*.

Transformers 76*a* and 76*b* are 1 to 2 unbalanced 50 ohm to balanced 100 ohm, 180° power dividers. The two center conductors of the two output ports of transformers 76*a* and 76*b* are connected to respective transmission lines 72*a* and 72*b* at the ends where the shortest elements 64*a* and 64*b*; and 64*c* and 64*d* are respectively connected.

A broadband impedance match is accomplished by adjusting the element lengths so that the elements have four resonances near or in the band. These resonances are:

| Resonance | Element | Length |
|---|---|---|
| ~235 MHz | n | 3/4 wavelength (33.43") |
| ~300 MHz | n + 1 | 3/4 wavelength (25.88") |
| ~400+ MHz | n | 5/4 wavelength (33.43") |
| ~480 MHz | n + 2 | 3/4 wavelength (17.42") |

Refer now particularly to FIG. 4. Smoothing the impedance match is done by adjusting the element feed point separations $d_3$ (74) and $d_4$ (75) on the transmission lines, by adjusting the relative starting positions $d_5$ (82) and $d_6$ (83) of adjacent elements on the fiberglass tube 66, and by adjusting the transmission line separation $d_7$ (85) which in turn adjusts the characteristic impedance (Zo) of transmission line 84. The transmission line $d_7$ (85) separation was set at approximately ⅜".

Patternwise, cardioid shaped patterns occur for a whole band of 200 MHz to 400 MHz. However, particular care must be taken to obtain the desired cardioid patterns at the upper end of the band. Unlike a single element quadrifilar helix array, the pattern maximum can occur only on the open end 86 of the antenna at frequencies of approximately 360 MHz and higher. The direction of the main beam 88 in the forward fire mode is shown in FIG. 4. For best front/back ratio at these frequencies, element n+2 must be approximately ½ the length of element n. Yet, some overhead flattening of the patterns occurs at these frequencies and more radiation occurs near the horizon. However, this is acceptable since more gain is actually needed towards the horizon than overhead for satellite communication. The actual cause of this flattening of patterns is caused by element n radiating at 5/4 wavelength, which radiates with a null overhead. To compensate for this element, n+2 was found to have to be approximately ½ the length of the element n. This results in the ¾ resonance of element n+2 being shifted up and out of band to 480 MHz.

There has therefore been described a multiple element array that allows the antenna to be relatively short and broadband in terms of patterns and impedance. By having a phased array of elements whose ¾ wavelength resonances are space evenly across a large band, the desired broadbeamed cardioid shaped pattern of the ¾ wavelength resonance of an approximately ¾ turn antenna can be obtained continuously across a large band. The placement of the well matched ¾ wavelength resonances of the elements across a large band also allows a continuous good match across a large band. This large band match is the result of the overlapping of the smaller matched bands of the individual elements and occurs only if adjacent elements are fed 180° out of phase. If the elements were fed in phase, high VSWR peaks occur between the matched bands of the individual elements.

On the other hand a one element quadrifilar helix array cannot obtain the broadbeamed pattern over a large bandwidth as (1) broad beamed cardioid shaped patterns can be obtained across a large band only for long antennas of more than one turn and (2) antennas of less than one turn can maintain broadbeamed patterns at ¾ wavelength open resonance only over a small bandwidth. As the ¾ wavelength resonance of a ¾ turn antenna becomes a one wavelength antiresonance, an overhead null starts to form.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A phased array of quadrifilar helix antennas comprising:

a tube;

a first phase array of bifilar helixes wound on said tube, said first phased array of bifilar helixes having three bifilar helixes of unequal lengths;

a second phased array of bifilar helixes wound on said tube and spaced 90 degrees on said tube from said first phased array of bifilar helixes, said second phased array of bifilar helixes having three bifilar helixes of unequal lengths and identical to the respective members of said first phased array of three bifilar helixes;

first phasing means for feeding said first and second phased arrays of bifilar helixes 90 degrees out of phase with each other; and second phasing means for feeding adjacent bifilar helixes of said three bifilar helixes of said first phased array of bifilar helixes and adjacent bifilar helixes of said three bifilar helixes of said second phased array of bifilar helixes 180° out of phase with each other, said second phasing means including a first and a second transmission line connected to the respective bifilar helixes of said first and second phased arrays of bifilar helixes.

2. The phased array of quadrifilar helix antennas according to claim 1 further comprising:

said first and second phased array of three bifilar helixes of unequal lengths having the longest of said three bifilar helixes substantially twice the length of the shortest of said three bifilar helixes.

* * * * *